US009989327B2

(12) United States Patent
Horch

(10) Patent No.: US 9,989,327 B2
(45) Date of Patent: Jun. 5, 2018

(54) FIRE CONTROL GROUP WITH MULTIPLE USER-SELECTABLE TRIGGER PROFILES

(71) Applicant: Robert Adam Horch, Nashville, TN (US)

(72) Inventor: Robert Adam Horch, Nashville, TN (US)

( * ) Notice: Subject to any disclaimer, the term of this patent is extended or adjusted under 35 U.S.C. 154(b) by 0 days. days.

(21) Appl. No.: 15/636,979

(22) Filed: Jun. 29, 2017

(65) Prior Publication Data

US 2017/0299307 A1 Oct. 19, 2017

Related U.S. Application Data

(62) Division of application No. 14/563,935, filed on Dec. 8, 2014, now Pat. No. 9,719,744.

(60) Provisional application No. 61/912,788, filed on Dec. 6, 2013.

(51) Int. Cl.

| | |
|---|---|
| ***F41A 19/16*** | (2006.01) |
| ***F41A 19/14*** | (2006.01) |
| ***F41A 19/10*** | (2006.01) |
| ***F41A 19/12*** | (2006.01) |

(52) U.S. Cl.

CPC ..... *F41A 19/16* (2013.01); *F41A 19/10* (2013.01); *F41A 19/12* (2013.01); *F41A 19/14* (2013.01)

(58) Field of Classification Search

CPC ..... F41A 19/10; F41A 19/12; F41A 19/14; F41A 19/16; F41A 19/33; F41A 19/44; F41A 19/46; F41A 3/26; F41A 5/18

USPC ..... 42/69.01–69.03; 89/142, 132, 144, 136

See application file for complete search history.

(56) References Cited

U.S. PATENT DOCUMENTS

| | | | | |
|---|---|---|---|---|
| 3,045,555 | A * | 7/1962 | Stoner | F41A 19/46 89/142 |
| 3,292,492 | A * | 12/1966 | Sturtevant | F41A 19/02 89/128 |
| 5,251,533 | A | 10/1993 | Layton | |
| 5,501,134 | A | 3/1996 | Milazzo et al. | |
| 5,760,328 | A | 6/1998 | Robbins | |
| 5,881,485 | A | 3/1999 | Milazzo | |
| 6,615,527 | B1 | 9/2003 | Martin | |
| 7,398,723 | B1 | 7/2008 | Blakley | |
| 7,421,937 | B1 | 9/2008 | Gangl | |
| 7,587,851 | B1 | 9/2009 | Luth | |
| 7,600,338 | B2 | 10/2009 | Geissele | |
| 7,854,084 | B1 | 12/2010 | Rutherford | |
| 8,112,928 | B2 | 2/2012 | Keough | |
| 8,667,881 | B1 | 3/2014 | Hawbaker | |
| 8,985,006 | B1 | 3/2015 | Christensen et al. | |
| 9,310,150 | B1 | 4/2016 | Geissele | |
| 9,869,522 | B2 * | 1/2018 | Larson, Jr. | F41A 19/16 |
| 2004/0020094 | A1 | 2/2004 | Ealovega | |

(Continued)

*Primary Examiner* — Jonathan C Weber

(74) *Attorney, Agent, or Firm* — Waller Lansden Dortch & Davis LLP; Blake M. Bernard

(57) ABSTRACT

A fire control group is capable of operating in multiple, user-selectable modes. The fire control group includes two disconnectors, a selector switch, and a trigger with a tang. The selector switch has a series of cams which interact with the tang of the trigger and surfaces of the two disconnectors to provide different hammer break points (i.e., distances from neutral), reset distances, overtravel distances, and pull weights, depending on a rotational position of the selector switch. In one embodiment, the fire control group is capable of a safe mode, a 2-stage trigger pull, and a 1-stage trigger pull.

10 Claims, 13 Drawing Sheets

(56) References Cited

U.S. PATENT DOCUMENTS

| | | | |
|---|---|---|---|
| 2006/0086031 | A1 | 4/2006 | Geissele |
| 2009/0151213 | A1 | 6/2009 | Bell |
| 2009/0183414 | A1 | 7/2009 | Geissele |
| 2009/0188145 | A1 | 7/2009 | Fluhr et al. |
| 2011/0185615 | A1 | 8/2011 | Gangl |
| 2014/0259845 | A1 | 9/2014 | Johnson |
| 2014/0366418 | A1 | 12/2014 | Stakes |
| 2015/0068090 | A1 | 3/2015 | Christensen et al. |
| 2015/0153125 | A1 | 6/2015 | Lutton et al. |
| 2015/0153126 | A1 | 6/2015 | Bender |
| 2016/0018176 | A1 | 1/2016 | Fellows et al. |

* cited by examiner

FIRE CONTROL GROUP WITH MULTIPLE USER-SELECTABLE TRIGGER PROFILES

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCE TO RELATED APPLICATIONS

This application claims the benefit of U.S. Provisional Application No. 61/912,788, entitled "FIRE CONTROL GROUP WITH MULTIPLE USER-SELECTABLE TRIGGER PROFILES", filed Dec. 6, 2013 and U.S. patent application Ser. No. 14/563,935, entitled "FIRE CONTROL WITH MULTIPLE USER-SELECTABLE TRIGGER PROFILES, filed Dec. 8, 2014, the entire contents of which are incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to fire control groups (i.e., trigger groups). More particularly, this invention pertains to fire control or trigger groups having user selectable characteristics.

Depending on the usage scenario, it is desirable for a firearm to have either a trigger for duty shooting (i.e., a standard trigger profile) or a trigger for rapid fire (e.g., a precision trigger). A duty trigger is characterized by a predictable trigger pull with considerable trigger pull weight and travel, thereby preventing accidental discharge. However, these features impede rapid firing and high precision bench firing. A rapid fire or precision trigger should have minimal pull weight and travel so as to be quick and effortless to operate, but such features add a degree of unpredictability to the trigger that reduces safety in normal shooting and handling scenarios. Given the difference in desirable characteristics between duty and rapid rife or precision triggers, rifles and handguns have heretofore been equipped with either one type of trigger or the other.

BRIEF SUMMARY OF THE INVENTION

Aspects of the present invention enable a user to modify a trigger profile of a firearm by moving a safety/selector switch among three positions. In one embodiment, the trigger profiles achieved include safe, duty, and rapid fire. Alternatively, the trigger profiles achieved could include any of safe, duty, rapid fire, and precision. In one embodiment, the duty profile is implemented in a 2-stage design and the rapid fire profile is implemented by a 1-stage design to aid in ease of operation. Both types of trigger profiles mechanically coexist within the same rifle, and the operator can quickly select the appropriate trigger profile by operating the selector switch via a lever attached thereto.

In one aspect of the invention, a complete fire control group for AR15-patterned firearms (see, for example, FIGS. 1, 7, and 9), includes a trigger, a trigger spring, a trigger pin, two disconnectors, two disconnector springs, a selector switch, a hammer (i.e., a firing mechanism), a hammer pin (i.e., a firing mechanism pin), and a hammer spring (i.e., a firing mechanism spring), that collectively provide three modes of operation: safe, 2 stage, and 1 stage. In safe mode, the firearm will not discharge when the trigger is pulled or the firearm is dropped from typical heights encountered by operators (e.g., 10 feet or less). In 2-stage semiautomatic mode, pretravel consists of two different pull weights and is intended for standard or duty fire wherein safety and trigger control are imperative. Overtravel and reset are significant so as to be positively felt by the operator. In 1-stage semiautomatic mode, pretravel is significantly shorter than the 2-stage mode and has a single pull weight that is significantly lighter than the 2-stage mode; overtravel and reset are minimized so as to be barely felt or imperceptible to the operator.

In another aspect, one of the fire control group's modes of operation can be chosen at any time via a lever on a three-way selector switch, which is actuated by operator. In one embodiment, the lever facing to a rear of the firearm engages safe mode; the lever facing down engages 2-stage semiautomatic mode; and the lever facing forward (i.e., generally toward a muzzle of the firearm) engages 1-stage semiautomatic mode.

In another aspect, multiple modes of operation are achieved with a trigger, fire control selector switch, and at least two disconnectors. Referring to FIGS. 11 and 12, a trigger tang of the trigger engages selector switch to alter pretravel and overtravel differently depending on selector switch position. The selector switch includes a first set of cam surfaces intended to adjust pretravel and overtravel depending on selector switch position and a second set of cam surfaces intended to engage or disengage one or more disconnectors (see, for example, FIGS. 11 and 12). The compound trigger sear surface engages the hammer to adjust trigger pull weight depending on trigger pull distance (FIG. 8). The two disconnectors have a common pivot point (e.g., trigger pin) but each have different spring capture points, thereby creating differential torque on each disconnector (when seated in the trigger and using two disconnector springs of same stiffness). Alternatively, the disconnector springs may be at the same distance from the common pivot, but utilize 2 disconnector springs having different spring rates, or the operator can further the torque differential during trigger installation by using two springs of different stiffness. This torque differential contributes to the trigger pull weight difference between 1-stage and 2-stage modes of operation.

In another aspect, different trigger pull weights in at least two trigger pull profiles (e.g., firing modes) are achieved by a combination of two disconnector springs imparting different forces on the trigger via disconnector to selector switch engagement (e.g., different spring rates and/or different distances from the trigger pin), and compound geometry of the trigger sear.

In another aspect, a fire control group for a firearm includes a firing mechanism, a selector switch, a first disconnector, a second disconnector, and a trigger. The firing mechanism is operable to discharge the firearm upon release. The firing mechanism includes a firing mechanism sear surface and a disconnector engagement surface. The selector switch has a first firing position corresponding to a first firing mode and a second firing position corresponding to a second firing mode. The selector switch includes a first plurality of cam surfaces and a second plurality of cam surfaces. The first plurality of cam surfaces is configured to determine a trigger pull weight, and overtravel distance, a neutral position, and a reset point of the first firing mode. The second plurality of cam surfaces is configured to determine a trigger pull weight, and overtravel distance, a neutral position, and a reset point of the second firing mode. The first disconnector is configured to engage at least one cam surface of the first plurality of cam surfaces when the firearm is discharged with the selector switch and the first firing position. The first disconnector is further configured to capture the firing mechanism subsequent to discharge of the firearm when the selector switches in the second firing position by engaging the disconnector engagement surface of the firing mechanism. The second disconnector is configured to engage at least one cam surface of the second plurality of cam surfaces when the firearm is discharged with the selector switch and the second firing position. The second disconnector is further configured to capture the firing mechanism subsequent to discharge of the firearm when the selector switches in the first firing position by engaging the disconnector engagement surface of the firing mechanism. The trigger includes a trigger sear surface, a trigger shoe, and a trigger tang. The trigger sear surface is configured to engage the firing mechanism sear surface prior to the breakpoint and upon reset in the first firing mode and prior to the breakpoint and upon reset in the second firing mode. The trigger shoe is operable to receive user input for displacing the trigger to release the firing mechanism by rotating the trigger about a firing pin to disengage the trigger sear surface from the firing mechanism sear surface. The trigger tang is configured to engage the selector to set the neutral position in the first firing mode, set the initial position in the second firing mode, set the overtravel distance in the first firing mode, and set the overtravel distance of the second firing mode.

In another aspect, a fire control group for a firearm includes a firing mechanism, a selector switch, a first disconnector, and a trigger. The firing mechanism is operable to discharge the firearm upon release. The firing mechanism includes a firing mechanism sear surface and a disconnector engagement surface. The selector switch has a first firing position corresponding to a first firing mode and a second firing position corresponding to a second firing mode. The selector switch includes a first plurality of cam surfaces and a second plurality of cam surfaces. The first plurality of cam surfaces is configured to determine a trigger pull weight, and overtravel distance, a neutral position, and a reset point of the first firing mode. The second plurality of cam surfaces is configured to determine a trigger pull weight, and overtravel distance, a neutral position, and a reset point of the second firing mode. The first disconnector is configured to engage at least one cam surface of the first plurality of cam surfaces when the firearm is discharged with the selector switch and the first firing position. The first disconnector is configured to capture the firing mechanism subsequent to discharge of the firearm by engaging the disconnector engagement surface of the firing mechanism. The trigger includes a trigger sear surface, a trigger shoe, and a trigger tang. The trigger sear surface is configured to engage the firing mechanism sear surface prior to the breakpoint and upon reset in the first firing mode and prior to the breakpoint and upon reset in the second firing mode. The trigger shoe is operable to receive user input for displacing the trigger to release the firing mechanism by rotating the trigger about a firing pin to disengage the trigger sear surface from the firing mechanism sear surface. The trigger tang is configured to engage the selector to set the neutral position in the first firing mode, set the initial position in the second firing mode, set the overtravel distance in the first firing mode, and set the overtravel distance of the second firing mode.

In another aspect, a fire control group for a firearm includes a firing mechanism, a selector switch, a first disconnector, and a trigger. The firing mechanism is operable to discharge the firearm upon release. The firing mechanism includes a firing mechanism sear surface and a disconnector engagement surface. The selector switch has a first firing position corresponding to a first firing mode and a second firing position corresponding to a second firing mode. The selector switch includes a first plurality of cam surfaces and a second plurality of cam surfaces. The first plurality of cam surfaces is configured to determine a trigger pull weight, and overtravel distance, a neutral position, and a reset point of the first firing mode. The second plurality of cam surfaces is configured to determine a trigger pull weight, and overtravel distance, a neutral position, and a reset point of the second firing mode. The first disconnector is configured to engage at least one cam surface of the first plurality of cam surfaces when the firearm is discharged with the selector switch and the first firing position. The first disconnector is configured to capture the firing mechanism subsequent to discharge of the firearm by engaging the disconnector engagement surface of the firing mechanism and to engage the firing mechanism during a second stage of the two-stage firing mode to alter the trigger pull weight. The trigger includes a trigger sear surface, a trigger shoe, and a trigger tang. The trigger sear surface is configured to engage the firing mechanism sear surface prior to the breakpoint and upon reset in the first firing mode and prior to the breakpoint and upon reset in the second firing mode. The trigger shoe is operable to receive user input for displacing the trigger to release the firing mechanism by rotating the trigger about a firing pin to disengage the trigger sear surface from the firing mechanism sear surface. The trigger tang is configured to engage the selector to set the neutral position in the first firing mode, set the initial position in the second firing mode, set the overtravel distance in the first firing mode, and set the overtravel distance of the second firing mode.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
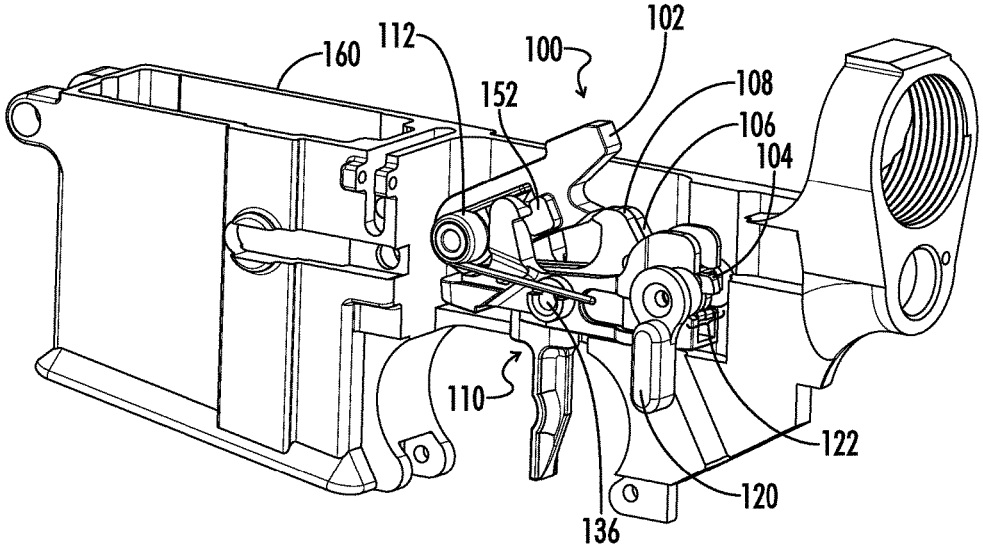
FIG. 1 is a cutaway isometric view of an AR-15 style lower receiver having a fire control group capable of multiple, user selectable trigger pull profiles.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. All relationships are described herein with respect to a firearm (and its trigger group or fire control group) being held approximately level with a muzzle of the firearm being forward and a butt of the firearm being rearward. Lateral is perpendicular to the vertical plane when the firearm is held in the upright and level position with the trigger in a vertical orientation.

Referring to FIGS. 1-6E, a fire control group 100 for a firearm includes a firing mechanism (e.g., hammer 102), a selector switch 104, a first disconnector 106, a second disconnector 108, and a trigger 110. In one embodiment, the fire control group 100 further includes a trigger/hammer spring 112. The hammer 102 is operable to strike a bullet primer to discharge the firearm upon release from the trigger 110. In one embodiment, the hammer 102 is forced forward by the trigger spring 112 when the hammer 102 is released by the trigger 110. The hammer 102 includes a firing mechanism sear surface 118 (e.g., hammer sear surface) and a disconnector engagement surface 128. The hammer 102 is released when the hammer sear surface 118 disengages from a trigger sear surface 116 of the trigger 110.

The selector switch 104 has a first firing position corresponding to a first firing mode and a second firing position corresponding to a second firing mode. In one embodiment, the selector switch 104 further includes a lever 120, and the selector switch 104 has a safe position and mode of operation. The lever 120 is substantially outside of a receiver 160 of the firearm. The lever 120 is configured to rotate the selector switch 104 from the first firing position to the second firing position and from the second firing position to the first firing position. In one embodiment, the safe position is with the lever 120 pointing rearward from a cam section 122 of the selector switch 104, the first firing position is with the lever 120 pointing downward from the cam section 122, and the second firing position is with the lever 120 pointing forward from the cam section 122. The selector switch 104 includes a first plurality of cam surfaces configured to determine a trigger pull weight, and overtravel distance, a neutral position, and a reset point of the first firing mode. The selector switch 104 further includes a second plurality of cam surfaces configured to determine a trigger pull weight, and overtravel distance, a neutral position, and a reset point of the second firing mode.

The first disconnector 106 is configured to engage at least one cam surface of the first plurality of cam surfaces when the firearm is discharged with the selector switch 104 in the first firing position. The first disconnector 106 is further configured to capture the firing mechanism 102 subsequent to discharge of the firearm when the selector switch 104 is in the second firing position by engaging the disconnector engagement surface 128 of the firing mechanism 102. The first disconnector 106 is further configured to reset the trigger sear surface 116 in contact with the firing mechanism sear surface 118 when the trigger 110 is returned to a first reset point after discharge of the firearm.

The second disconnector 108 is configured to engage at least one cam surface of the second plurality of cam surfaces when the firearm is discharged with the selector switch 104 in the second firing position. The second disconnector 108 is also configured to capture the firing mechanism 102 subsequent to discharge of the firearm when the selector switch 104 is in the first firing position by engaging the disconnector engagement surface 128 of the firing mechanism 102 (i.e., hammer 102).

The trigger 110 includes the trigger sear surface 116, a trigger shoe 113, and a trigger tang 130. The trigger tang 130 has an upper surface of a lower portion 132 and a lower surface of an upper portion 134 configured to engage surfaces of the selector switch 104 to set the neutral position and overtravel distance for the trigger shoe 113 in each firing mode (e.g., safe, first firing mode, and second firing mode). The upper surface of the lower portion 132 determines the overtravel distance in each of the safe, first firing mode, and second firing mode. The lower surface of the upper portion 134 determines the neutral position in each of the safe mode, first firing mode, and second firing mode. The trigger sear surface 116 is configured to engage the firing mechanism sear surface 118 prior to the breakpoint and upon reset in the first firing mode. The trigger sear surface 116 is further configured to engage the firing mechanism sear surface 118 prior to the breakpoint and upon reset in the second firing mode. The trigger shoe 113 is operable to receive user input for displacing the trigger 110 to release the firing mechanism 102 by rotating the trigger 110 about a trigger pin 136 to disengage the trigger sear surface 116 from the firing mechanism sear surface 118. In one embodiment, the first disconnector 106 and the second disconnector 108 are also configured to rotate about the trigger pin 136.

Figure 2:
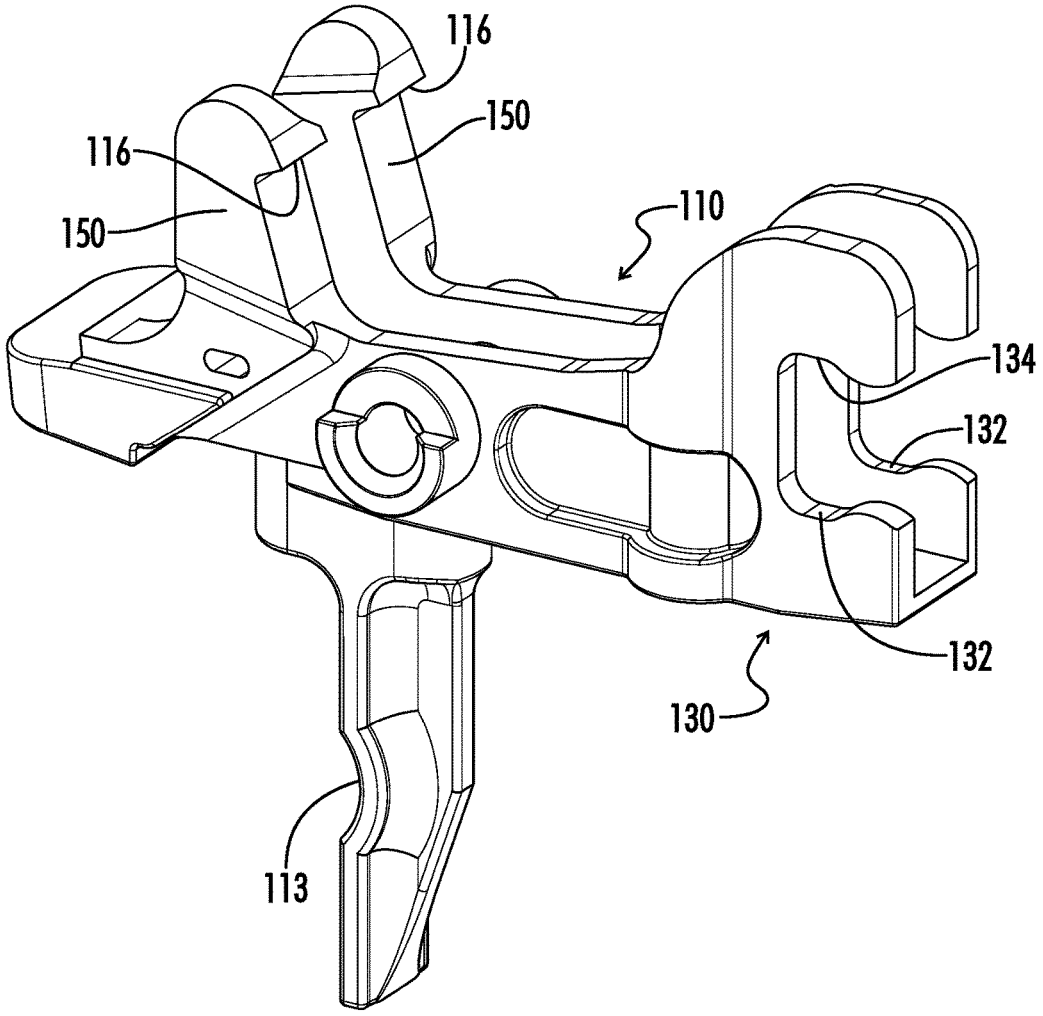
FIG. 2 is an isometric view of a trigger of the fire control group of FIG. 1.
Figure 3:
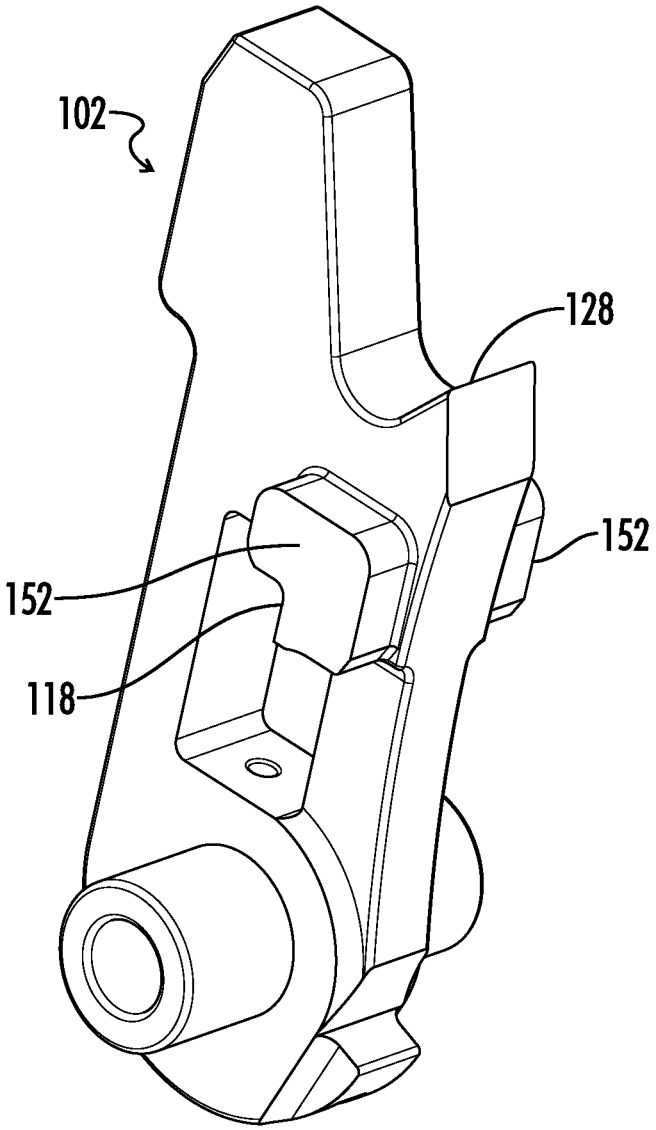
FIG. 3 is an isometric view of a hammer (i.e., firing mechanism) of the fire control group of FIG. 1.
Figure 4:
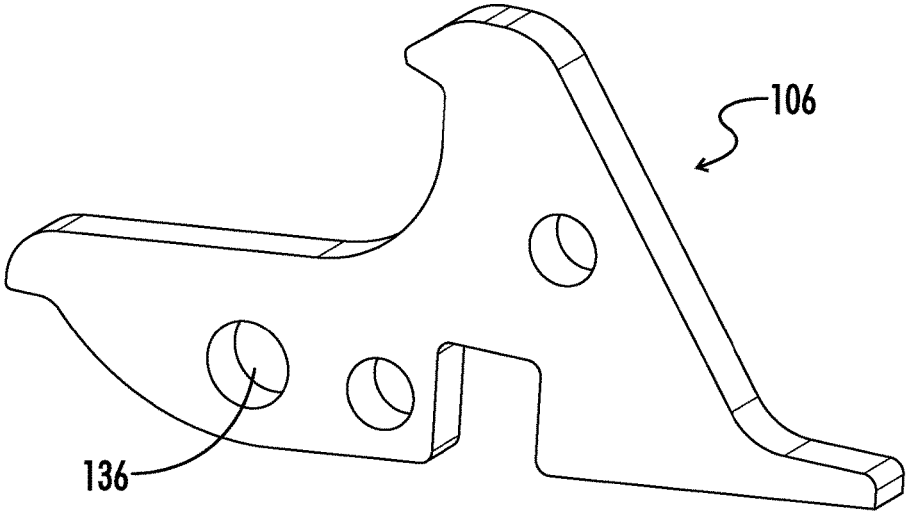
FIG. 4 is an isometric view of a first disconnector of the fire control group of FIG. 1.
Figure 5:
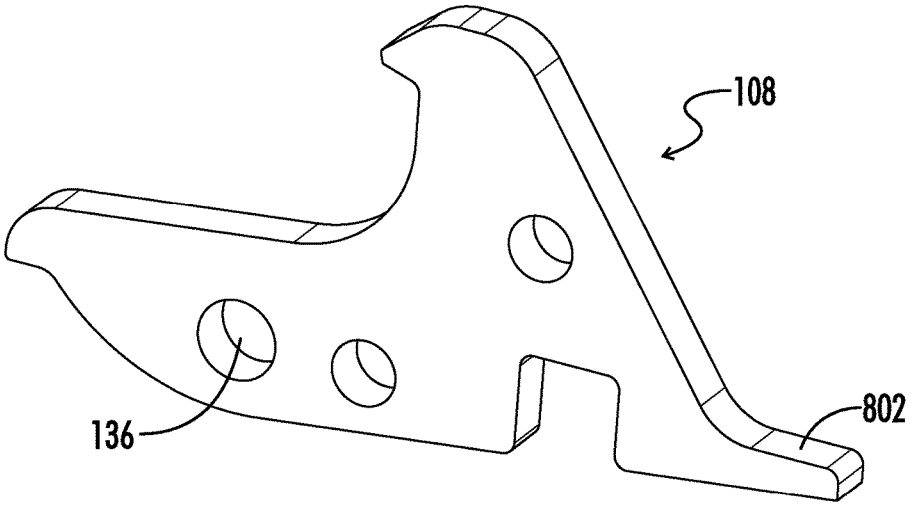
FIG. 5 is an isometric view of a second disconnector of the fire control group of FIG. 1.
Figure 6A:
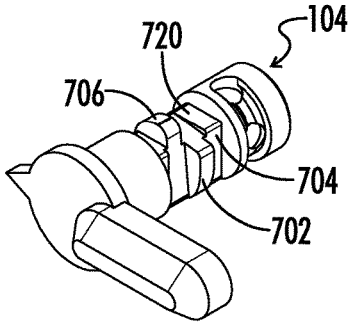
FIG. 6A is a rear isometric view of a selector switch of the fire control group of FIG. 1 in a safe mode or position.
Figure 6B:
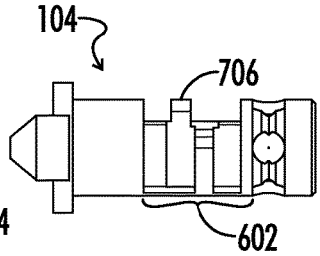
FIG. 6B is a rear perspective view of a selector switch of the fire control group of FIG. 1 in a safe mode or position.
Figure 6D:
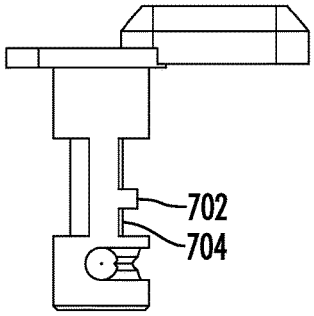
FIG. 6D is a bottom perspective view of a selector switch of the fire control group of FIG. 1 in a safe mode or position.
Figure 6C:
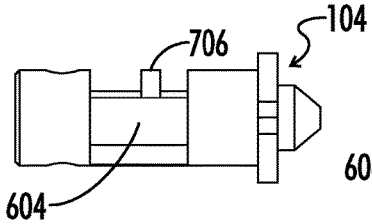
FIG. 6C is a front perspective view of a selector switch of the fire control group of FIG. 1 in a safe mode or position.
Figure 6E:
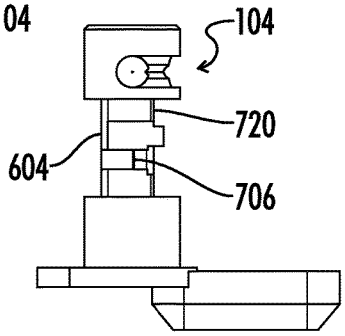
FIG. 6E is a top perspective view of a selector switch of the fire control group of FIG. 1 in a safe mode or position.
Figure 7A:
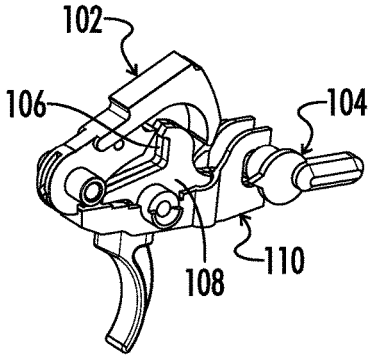
FIG. 7A is a front isometric view of a fire control group with an AR-15 type hammer sear arrangement.
Figure 7D:
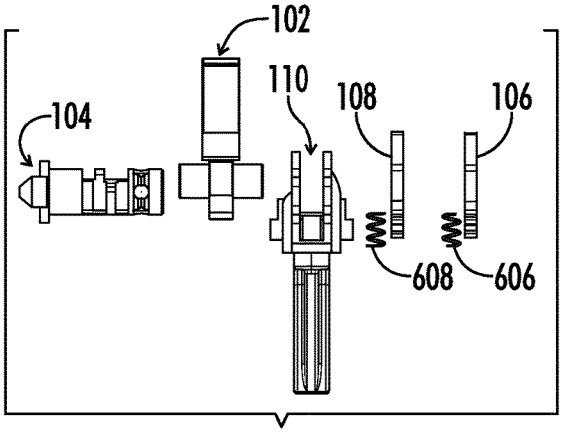
FIG. 7D is an exploded rear perspective view of the fire control group of FIG. 7A.
Figure 7B:
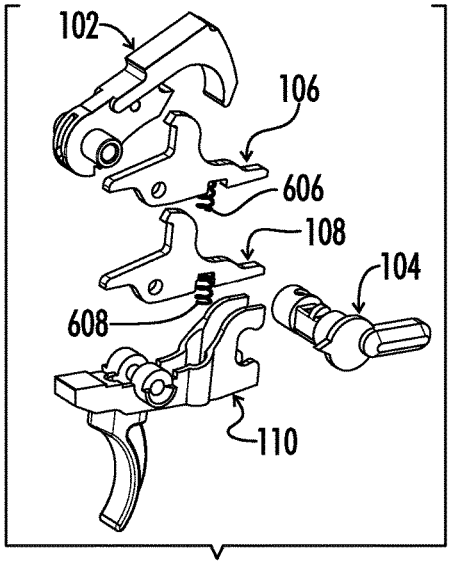
FIG. 7B is an exploded front isometric view of the fire control group of FIG. 7A.
Figure 7E:
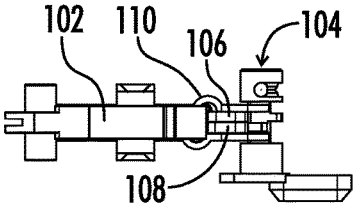
FIG. 7E is a top perspective view of the fire control group of FIG. 7A.
Figure 7C:
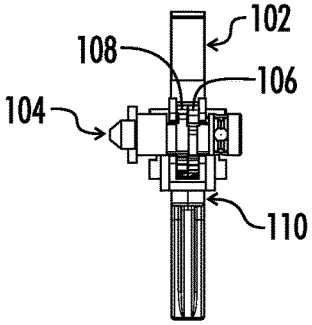
FIG. 7C is a rear perspective view of the fire control group of FIG. 7A.
Figure 7F:
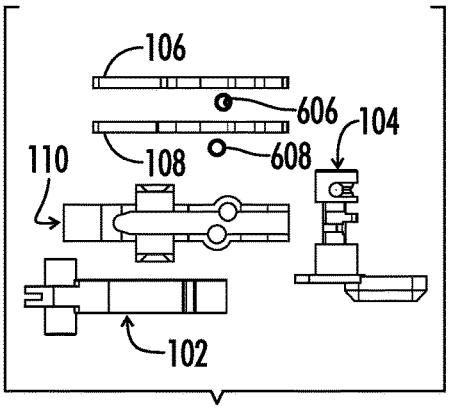
FIG. 7F is an exploded top perspective view of the fire control group of FIG. 7A.
Figure 8:
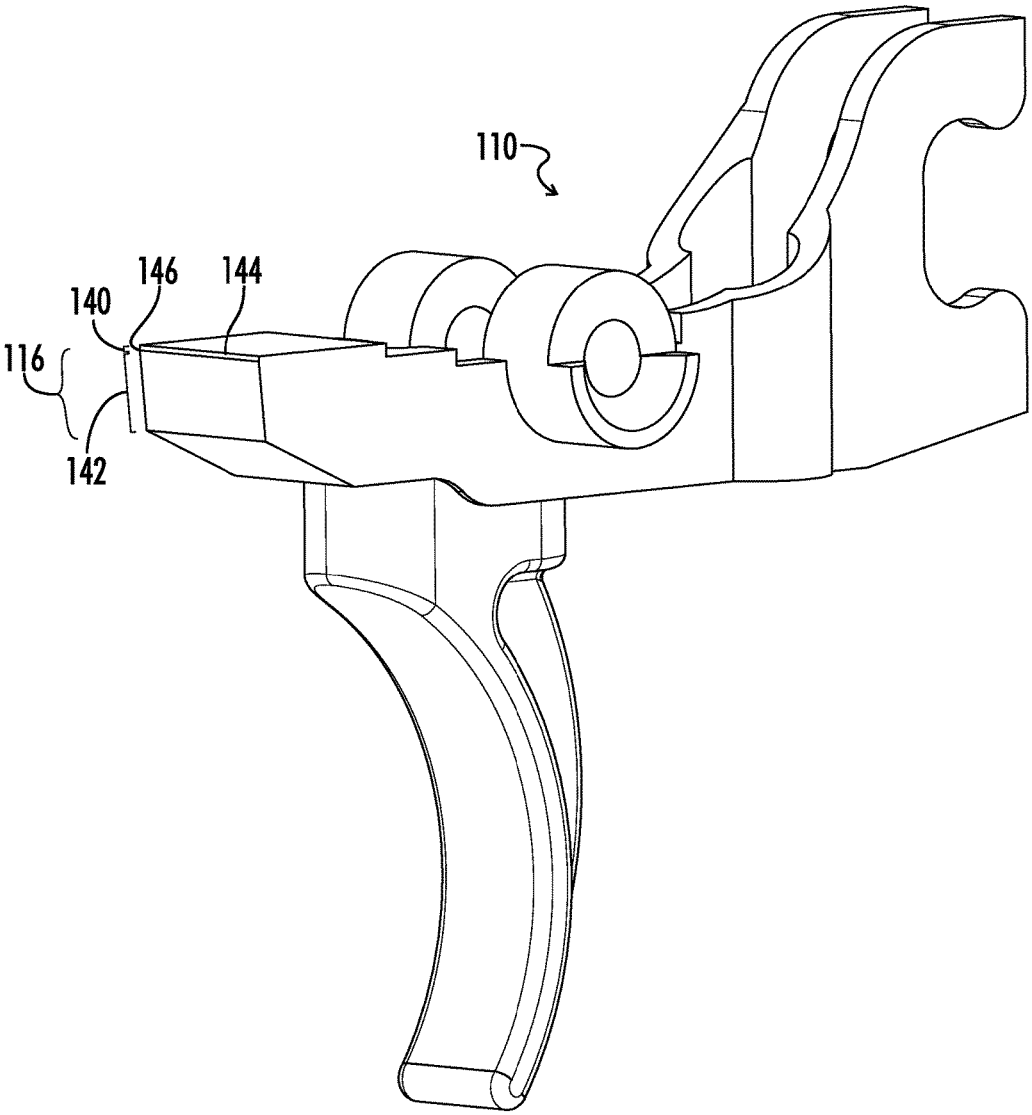
FIG. 8 is a front isometric view of a trigger of the fire control group of FIG. 7A.
Figure 9A:
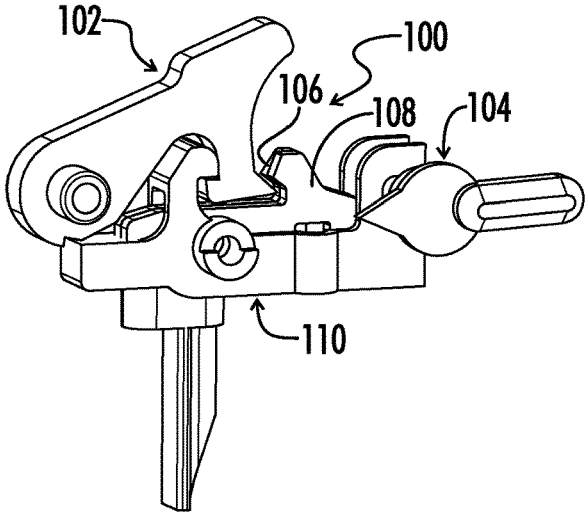
FIG. 9A is an isometric view of a fire control group having a hollow hammer sear.
Figure 9B:
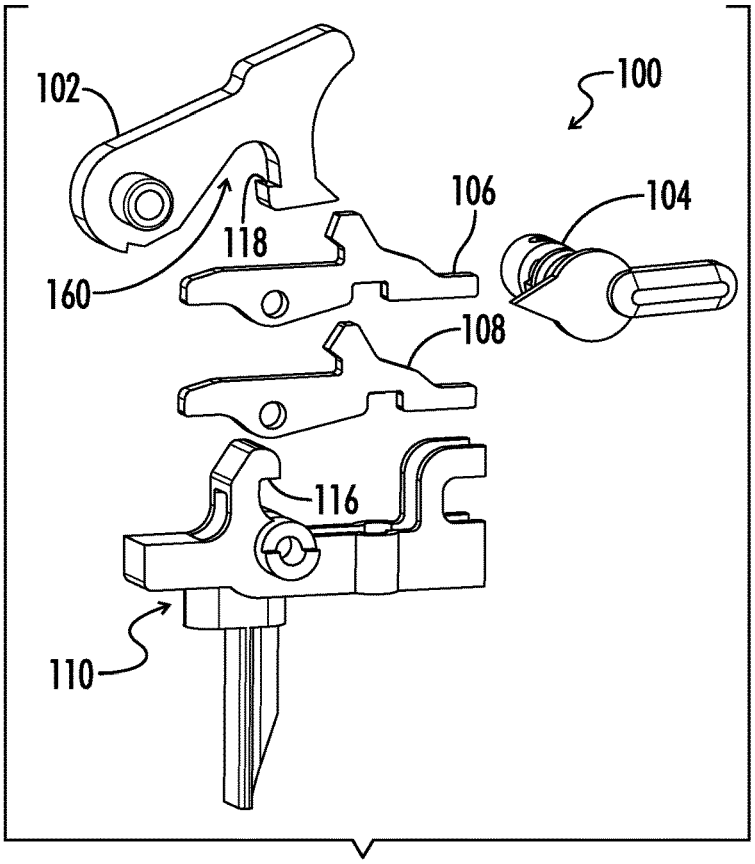
FIG. 9B is an exploded isometric view of the fire control group of FIG. 9A.

There are a number of different ways for the trigger sear surface 116 to interact with the firing mechanism sear surface 118 (see, for example, FIGS. 1, 7, and 9A). Referring to FIGS. 7A-8, in one embodiment, the trigger sear surface 116 is a compound trigger sear surface having a first surface 140 and a second surface 142. A first engagement edge 144 runs along an edge of the first surface 140 (lateral to the firearm), and a second engagement edge 146 runs along an edge of the second surface 142 (lateral to the firearm and parallel to the first engagement edge 144). The first engagement edge 144 has a lower angle of incidence to the firing mechanism sear surface 118 than the second engagement edge 146. In the first firing mode, (i.e., the two-stage firing mode) the second engagement edge 146 disengages the firing mechanism sear surface 118 then the first engagement edge 144 disengages from the firing mechanism sear surface 118 when the trigger shoe 113 is moved rearward from the neutral position of the first firing mode to release the firing mechanism 102. In the second firing mode, (i.e., the one stage firing mode) only the first surface 140 can engage the firing mechanism sear surface 118 while the selector switch 104 is in the second position such that the second engagement edge 146 does not significantly engage the firing mechanism sear surface 118 as the trigger shoe 113 is moved rearward from the neutral position of the second firing mode to release the firing mechanism 102. Referring to FIGS. 1-3, in another embodiment of trigger sear surface 116 and firing mechanism sear surface 118, the trigger sear surface 116 is on a pillar 150 extending from the trigger pin 136 of the fire control group 100 when the firearm is in the upright position. The firing mechanism 102 includes a lateral protrusion 152 supporting the firing mechanism sear surface 118. In one embodiment, the trigger 110, first disconnector 106, and second disconnector 108 are rotationally bounced about the trigger pin 136. This makes the trigger group rotationally inert such that even when dropped from extreme heights, accidental discharges do not occur because the trigger 110 does not have any bias toward rotation regardless of the orientation of the firearm when it hits the ground. Referring to FIGS. 9A and 9B, yet another embodiment of a trigger sear surface 116 to firing mechanism sear surface 118 is shown. In this embodiment, the hammer 102 generally has a cutaway 160 and a lower surface thereof providing the firing mechanism sear surface 118.

Figure 10:
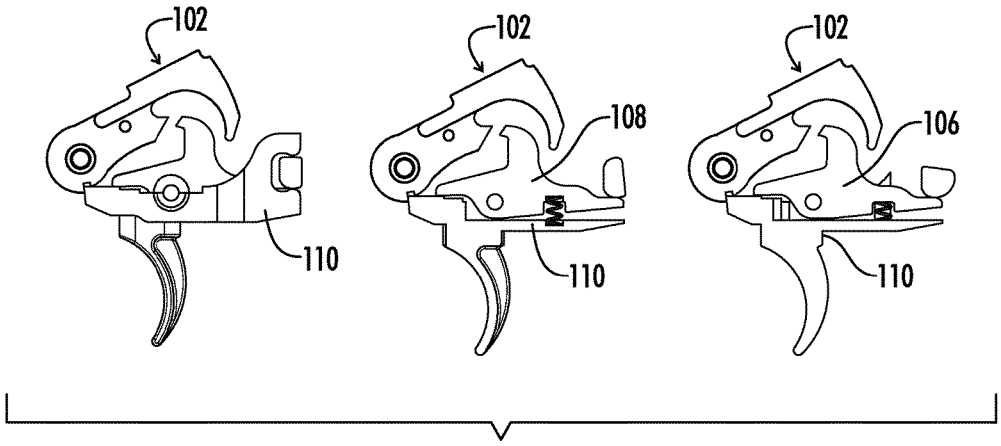
FIG. 10 is a series of cross sections of a fire control group capable of multiple, user selectable trigger pull profiles operating in a safe mode.

Referring to FIG. 10, the selector lever 104 is in a safe position (e.g., rearward) corresponding to a safe mode of operation or trigger profile. In the safe mode, the maximum trigger shoe 113 pull distance is determined by engagement between the top surface 132 of the tang 130 of the trigger 110 and a safety cam surface 602 of the selector switch 104. The trigger shoe 113 cannot be pulled any further rearward by the operator once the trigger tang 130 engages the selector lever 104, and the maximum pull distance is insufficient to disengage the hammer and trigger sear surfaces such that the firearm cannot be discharged. In this way, the safety cam surface 602 of the selector switch 104 substantially prevents displacement of the trigger shoe 113 from the neutral position of the first firing mode.

Figure 11:
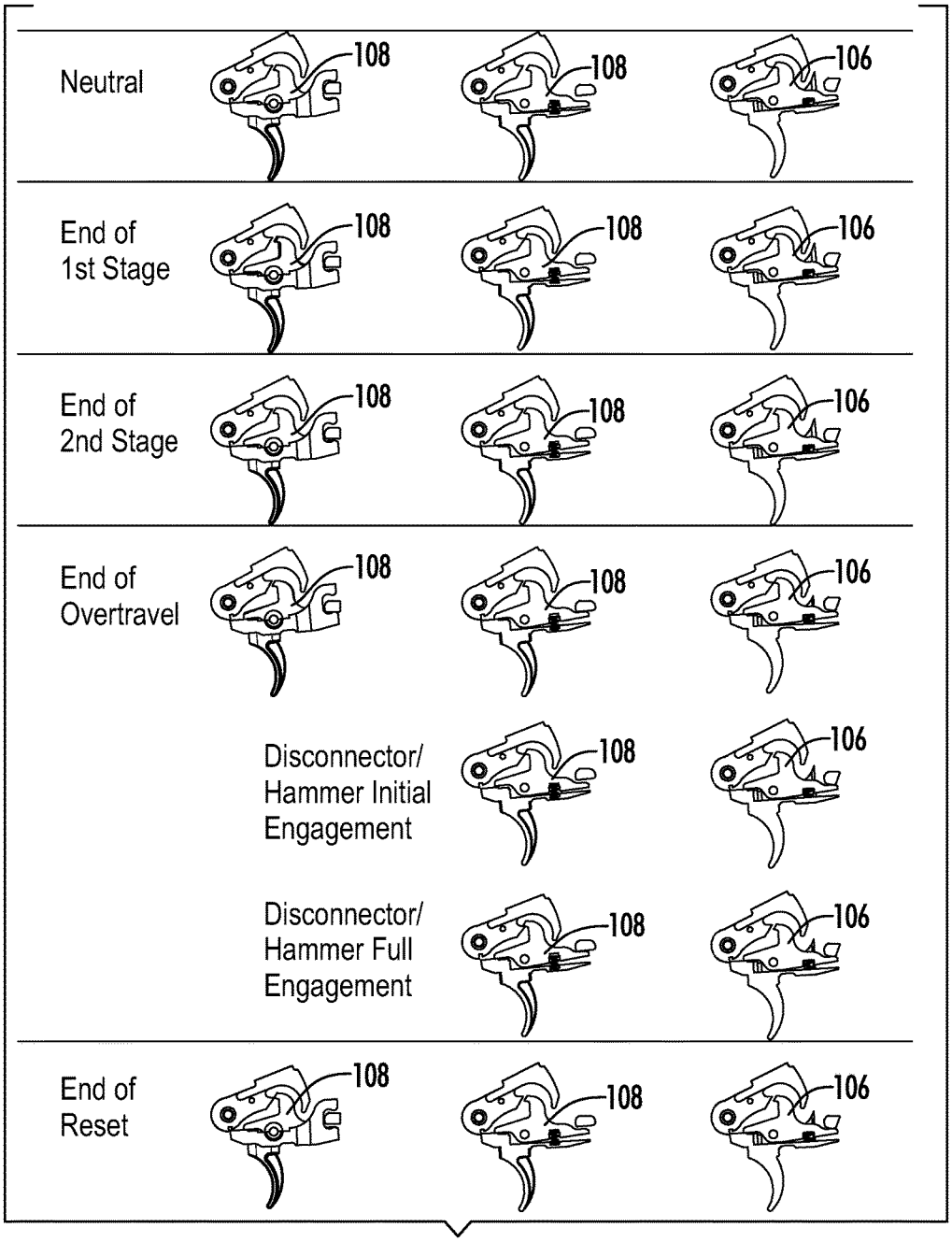
FIG. 11 is a series of cross sections of a fire control group capable of multiple, user selectable trigger pull profiles operating in a 2-stage mode.

Referring to FIG. 11, operation of a 2-stage trigger profile is shown. The selector switch 104 is placed in the second position (e.g., a downward position) to enable this trigger profile. The trigger shoe 113 begins at neutral position, which is defined by engagement between the bottom surface of a top portion of the trigger tang 134 and a 2-stage pretravel cam surface 604 of the selector lever 104 when the selector switch 104 is in the second position. During a first stage of the 2-stage trigger profile, pull weight (i.e., force required to move the trigger shoe rearward) is determined by a trigger spring rate, friction between the trigger sear surface 116 and firing mechanism sear surface 118, and a first disconnector spring rate (see 606 at FIGS. 7D and 7F) and position relative to the trigger pin 136 (i.e., distance between the first disconnector spring 606 and the trigger pin 136). The first stage of the 2-stage trigger profile ends after a pull distance sufficient to induce engagement between the second disconnector 108 and a 2-stage cam surface 702 of selector switch 104. During the second stage of the 2-stage trigger profile, trigger pull weight is determined by a combination of the trigger spring, friction between the trigger sear surface 116 and firing mechanism sear surface 118, the first disconnector spring rate and position relative to the trigger pin 136, and a second disconnector spring rate 608 and position relative to the trigger pin 136. The second stage ends after a pull distance allowing hammer break (e.g. pin break or breakpoint), which is defined by loss of engagement between trigger sear surface 116 and hammer sear 118. This allows the hammer or firing pin 102 to move forward under the force of the firing pin or hammer spring 112 and discharge the firearm. Overtravel begins in 2-stage operation while the hammer or firing pin 102 is in motion. Overtravel has a sharp decrease in pull weight to a pull weight determined by the combination of trigger spring and spring force of the first and second disconnector springs 606, 608. Overtravel ends at a pull distance corresponding to engagement between the top surface of the bottom portion of the trigger tang 132 with a 2-stage selector overtravel cam surface 704. The trigger shoe 113 cannot be pulled any further rearward at this point. After the firearm discharges, the hammer 102 is reset to a rearward position, contacting the second disconnector (e.g., 2-stage disconnector). As the hammer 102 is moving rearward during reset, a hammer disconnector surface 128 of the hammer (or firing pin) momentarily displaces the second disconnector (e.g., 2-stage disconnector) about a disconnector pivot, and the second disconnector 118 (e.g., 2-stage disconnector) captures the hammer via a disconnector surface 128 of the hammer. Engagement between the second disconnector 108 and the disconnector surface 128 of the hammer 102 prevents further forward movement of the hammer or firing pin. Because the first disconnector (e.g., 1-stage disconnector) 106 has been engaged by the 2-stage cam surface of selector 702 since the beginning of the second stage, the first disconnector 106 has been and remains pivoted sufficiently to the rear about the disconnector pivot so as to remove any possible engagement between the hammer disconnector surface 128 and the 1-stage disconnector (i.e., first disconnector). The 2-stage trigger reset pull profile begins when the operator allows trigger shoe 113 to move towards its neutral position while the hammer 102 is captured by the 2-stage disconnector 108. Reset trigger pull weight is determined by the combination of trigger spring, first disconnector spring force (during a portion of the reset), and engagement force between the hammer disconnector surface and the 2-stage disconnector. Reset of 2-stage pull ends when the trigger shoe returns (i.e., moves forward) to a pull distance allowing loss of engagement between hammer disconnector surface 128 and the 2-stage disconnector 108. When the hammer disconnector surface loses 128 contact with the second disconnector 108, the hammer and trigger sear surfaces resume engagement. The operator or user can then begin the firing sequence again from the reset pull distance or allow the trigger spring 112 to return the trigger shoe 113 to its neutral or starting position. The reset pull distance is greater (i.e, further rearward from neutral) than the first stage pull distance such that the firing sequence, if resumed from the reset pull distance, will encounter little to no first stage pull and a complete second stage pull.

Figure 12:
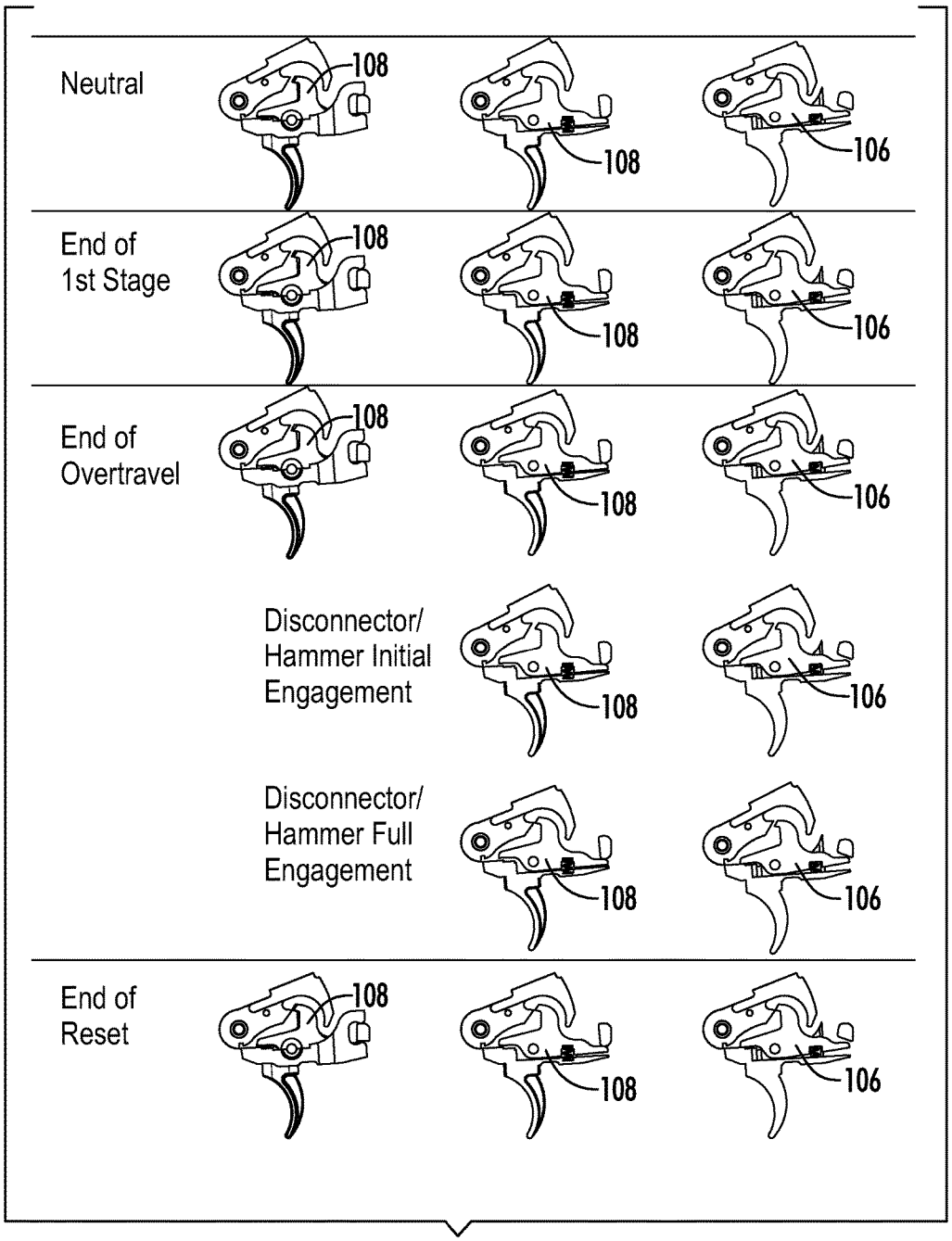
FIG. 12 is a series of cross sections of a fire control group capable of multiple, user selectable trigger pull profiles operating in a 1-stage mode.

Referring to FIG. 12, a cycle of the 1-stage trigger profile is shown. In one embodiment, to select the first trigger profile (e.g., the 1-stage trigger profile), the selector switch lever 104 is placed in a forward position (e.g., third position). The trigger shoe 113 begins at a neutral position, which is defined by engagement between the bottom surface of the top portion of the trigger tang 134 and selector 1-stage pretravel cam surface 602 (same surface as safety cam surface 602). Because the geometry of the selector lever pretravel cam is different than if the selector switch were in the two-stage position (e.g., second position), the 1-stage neutral position is a position corresponding roughly to the trigger shoe 113 position at the start of the second stage during 2-stage trigger profile operation. In this neutral position, and at all times during the 1-stage firing cycle, the end 802 of the second disconnector 108 is engaged by the 1-stage cam surface 706, thereby pivoting the 2-stage disconnector 108 sufficiently to the rear of the firearm to prevent engagement between the second disconnector 108 and the disconnector surface 128 of the hammer (or firing pin) 102. When the operator pulls the trigger shoe 113 rearward from neutral, the trigger shoe 113 has a pull weight determined by a combination of trigger spring (i.e., trigger return spring), friction between the trigger sear surface 116 and firing mechanism sear surface 118, and the second disconnector spring 608 rate and position relative to the trigger pin 136. Because the first and second stages of the compound trigger sear surface have different angles, and the first disconnector spring and second disconnector spring can be selected for different stiffnesses from one another, the trigger pull weight during 1-stage operation can be significantly lighter than the second stage trigger pull weight encountered during 2-stage trigger profile operation cycle. 1-stage pull ends when the pull distance increases to a point that causes the trigger sear surface 116 to disengage from the hammer sear surface 118. Since the 1-stage neutral position is a "pre-cocked" position corresponding to the end of the second pull stage in 2-stage operation, the pull distance to discharge is at the same position, but with significantly less travel from neutral, than the second and first stage pull distances encountered in the 2-stage trigger profile. The hammer or firing pin 102 is free to move forward and discharge the firearm when contact between the trigger sear surface 116 and hammer sear surface 118 is broken. Overtravel of 1-stage pull begins while the hammer 102 is moving forward with a sharp decrease in pull weight. The pull weight during overtravel is determined by the combination of trigger spring force and the second disconnector spring 608 force. Overtravel ends at a pull distance defined by engagement between the top surface of the bottom portion of the trigger tang 134 with a 1-stage selector overtravel cam surface 720 on the selector switch 104. The trigger shoe 113 cannot be pulled any further to the rear of the firearm. The geometry of the first selector overtravel cam 720 is different than the second selector overtravel cam 704. In one embodiment, the first selector overtravel cam 720 is configured such that the overtravel pull distance is significantly shorter than the overtravel pull distance of the 2-stage trigger profile. After the firearm discharges, the hammer 102 is forced rearward until the hammer disconnector surface 128 momentarily displaces the first disconnector 106 about the disconnector pivot. The first disconnector 106 captures the hammer disconnector surface 128 and prevents forward movement of the hammer 102. Reset begins when the operator allows the trigger spring 112 to move the trigger shoe 113 towards its neutral position (i.e., forward) while the hammer 102 is captured by the first disconnector 106. Reset pull weight is determined by the combination of trigger spring force and the second disconnector (i.e., 2-stage disconnector) spring force during entirety of the reset, and engagement force between the hammer disconnector surface 128 and the first disconnector (e.g., 1-stage disconnector 106). By selecting first and second disconnector springs 606, 608 with different stiffnesses, the reset pull weight is significantly lighter than that of the 2-stage trigger profile. Reset ends when the trigger shoe 113 reaches a pull distance allowing loss of engagement between the hammer disconnector surface 128 and the first disconnector 106 which results in hammer and trigger sear surfaces resuming engagement. Upon reset, the operator can discharge the firearm beginning at the reset pull distance or allow the trigger shoe to return to the neutral position. Reset pull distance is shorter than the overall first stage pull distance such that the firing sequence, if resumed from the reset pull distance, will encounter an abridged pull.

Example pull weight and travel characteristics of each trigger profile are:

| Selected Trigger Profile | Stage of Travel | Pull Distance from Neutral (Inches) | Peak Pull Weight (Pounds) |
|---|---|---|---|
| 2-stage | First (pretravel) | 0.060 | 3 |
| | Second (pretravel) | 0.070 | 4.5 |
| | Overtravel | 0.100 | 2 |
| | Reset | 0.040 | 2 |
| 1-stage | First (pretravel) | 0.010 | 3.5 |
| | Overtravel | 0.015 | 2 |
| | Reset | 0.005 | 2 |

Figure 13:
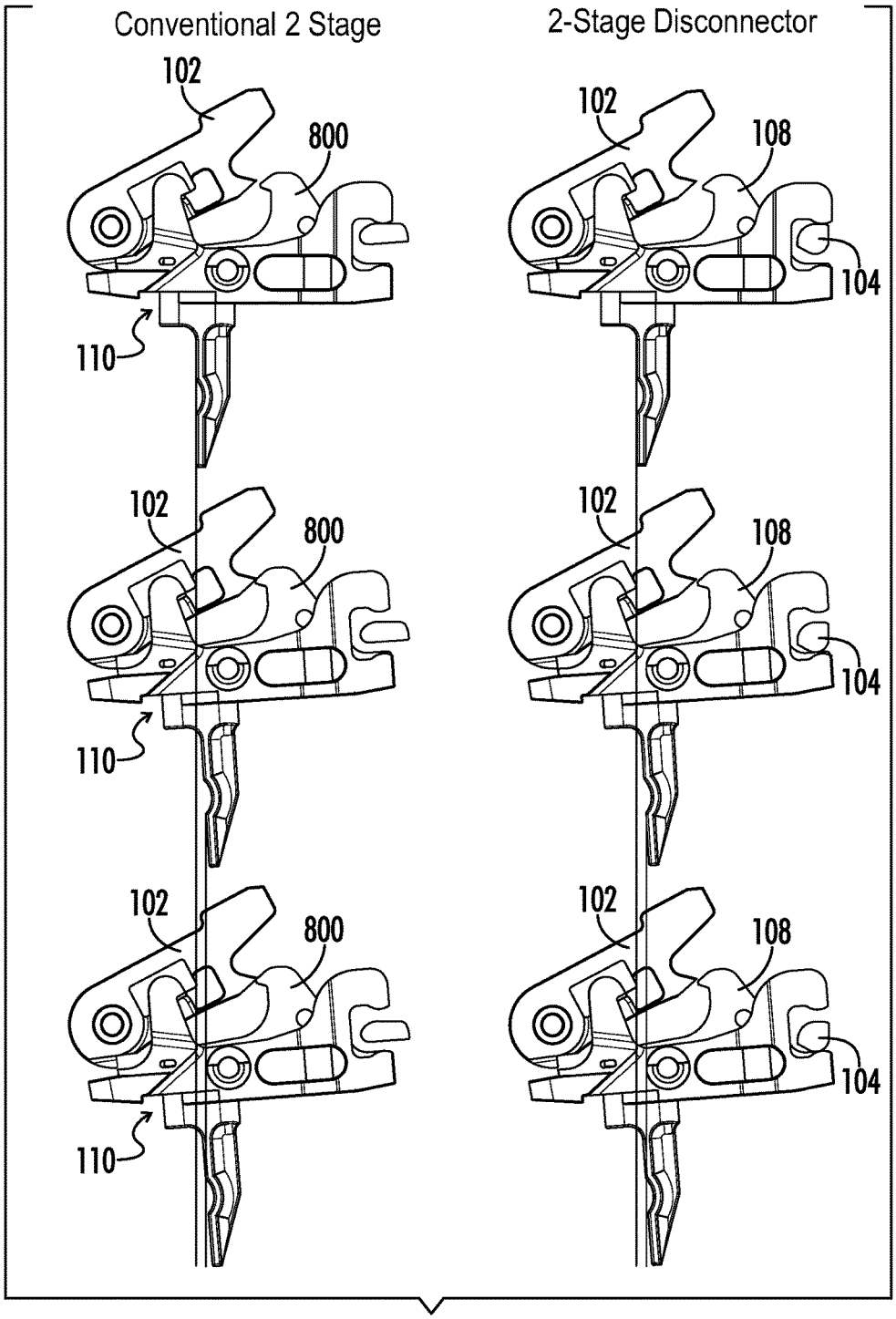
FIG. 13 is a series of cross sections of a fire control group capable of multiple, user selectable trigger pull profiles operating in a 2-stage mode wherein the second stage begins with contact between a disconnector and a firing mechanism of the fire control group.

Referring to FIG. 13, in one embodiment, 2-stage operation can be achieved with a single disconnector 800. The fire control group 100 operates as described above, but the second stage begins when a top of the disconnector 800 contacts a bottom of the disconnector engagement surface 128 of the hammer 102. The operator has to increase the applied force to move the hammer forward and out of contact with the disconnector 800. In one embodiment, an AR-15 style trigger sear surface and hammer arrangement is modified with a second disconnector and and 3 position selector lever. The AR-15 fire control group retains the standard location of hammer and trigger sear surfaces. The trigger and selector switch include features which enable two separate trigger profiles. The trigger sear surface has a compound sear surface including two engagement angles which modify the pull weight differential between single-stage and two-stage modes of operation.

In another embodiment, a hollowed trigger sear allows for potentially lower pull weights than AR-style design while maintaining military safety requirements. A hollow trigger sear allowing full operational movement of the first and second disconnectors within the trigger does not require a compound trigger sear surface to achieve varying trigger profiles (i.e., trigger pull profiles). This trigger and hammer sear surface arrangement may be similar to that of prior art by William H. Geissele (e.g., U.S. Pat. No. 7,331,136 and U.S. Pat. No. 7,600,338, the entirety of which is incorporated herein by reference). This is a modification of the standard AR-15 fire control group which repositions the primary hammer/trigger sear surfaces onto a hollowed-out feature on the trigger above the trigger pin hole (see FIGS. 9A and 9B). The hollow space partially accommodates both disconnectors. The hammer has an additional feature located facing away from the hammer disconnector engagement surface containing the hammer sear surface for engaging the trigger sear surface. Secondary sear surfaces are retained in the same orientation as the standard AR-15 design, but these surfaces do not engage during normal functioning of the trigger. Additionally, the sear surfaces do not employ compound geometry (they have a single fixed engagement angle). At all times during 2-stage trigger profile operation, the 1-stage disconnector is engaged by the selector switch 2-stage cam. The second stage of the 2-stage trigger profile is accomplished by impingement of the 2-stage disconnector on the hammer disconnector surface, rather than a sudden impingement of the 1-stage disconnector on the selector cam. Operation during 1-stage and 2-stage trigger pull profiles is similar to that described above. In this embodiment, example pull weight and distance characteristics of each trigger profile may be identical to those described above. However, the pull weights at any stage may be lighter because the sear surface locations create a longer lever arm than the standard AR-15 sear locations, which results in reduced friction force on the sear.

In another embodiment, a top-sear design allows for potentially lower pull weights than AR-style design while maintaining military safety requirements, and does not require compound trigger sear geometry as with the standard AR-15. This embodiment avoids similarity to the hollow trigger feature and additional sear surface described above. The primary hammer/trigger sear surfaces are positioned on two separate pillars on the trigger above the trigger pin hole (see FIG. 1). The location of the primary sear surfaces is similar to that of the hollow trigger feature described above, but the hammer pivot pin is avoided, and the pillars allow additional leverage from the trigger shoe to the trigger sear surface. The pillars also allow rotational balancing of the trigger, first disconnector, and second disconnector. Thus, trigger pull weight may be even lower than the two sear surface arrangements described above. The second stage of the 2-stage trigger profile mode of operation can be accomplished by either compound trigger sear surfaces or as described above with respect to the hollow trigger feature supporting the trigger sear surface.

The three selector positions and functions can be embodied in a variety of useful combinations. Selector positions can embody:

a. back=safe, down=2-stage duty, forward=1-stage rapid fire
b. back=safe, down=1-stage rapid fire, forward=2-stage duty
c. back=safe, down=1-stage duty, forward=1-stage rapid fire
d. back=safe, down=1-stage rapid fire, forward=1-stage duty Selector angles can embody:

a. back=0 degrees, down=90 degrees, forward=180 degrees
b. back=0 degrees, down=90 degrees, forward=135 degrees
c. back=0 degrees, down=45 degrees, forward=90 degrees An optional modification to all above embodiments include set screws housed separately in top and bottom of rear trigger tang for the purpose of fine-tuning pretravel and overtravel.

An optional modification to all above embodiments that include a set screw housed in the rear tang of each disconnector for the purpose of fine-tuning reset characteristics.

An operator is the user of the firearm. The operator may engage the trigger shoe with his index finger and selector lever with thumb to operate those components.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful FIRE CONTROL GROUP WITH MULTIPLE USER-SE- LECTABLE TRIGGER PROFILES it is not intended that such references be construed as limitations upon the scope of this invention except as set forth in the following claims.

What is claimed is:

1. A fire control group for a firearm, said fire control group comprising:

a firing mechanism operable to discharge the firearm upon release, said firing mechanism comprising a firing mechanism sear surface and a disconnector engagement surface;

a selector switch having a first firing position corresponding to a first firing mode and a second firing position corresponding to a second firing mode, said selector switch comprising:

a first plurality of cam surfaces configured to determine a trigger pull weight, an over travel distance, and a neutral position of the first firing mode;

a second plurality of cam surfaces configured to determine a trigger pull weight, an over travel distance, and a neutral position of the second firing mode;

a first disconnector configured to capture the firing mechanism subsequent to discharge of the firearm by engaging the disconnector engagement surface of the firing mechanism, wherein the second firing mode is a 2-stage mode, and a second stage of the 2 stage mode begins when the first disconnector contacts a surface of the second plurality of cam surfaces, increasing the pull weight as a function of a spring rate of a disconnector spring and a position of the disconnector spring relative to a trigger pin about which the first disconnector is configured to rotate;

a trigger comprising:

a trigger sear surface configured to engage the firing mechanism sear surface prior to the break point and upon reset in the first firing mode and prior to the break point and upon reset in the second firing mode;

a trigger shoe operable to receive user input for displacing the trigger to release the firing mechanism rotating the trigger about a trigger pin to disengage the trigger sear surface and the firing mechanism sear surface; and a trigger tang configured to engage the selector to set the neutral position in the first firing mode, set the neutral position in the second firing mode, set the over travel distance in the first firing mode, and set the over travel distance in the second firing mode.

2. The fire control group of claim 1, wherein:

the trigger sear surface is a compound trigger sear surface having a first engagement edge along a first surface and a second engagement edge along a second surface, wherein the first engagement edge has a lower angle of incidence to the firing mechanism sear surface than the second engagement edge;

the first firing mode is a 2-stage firing mode wherein the second engagement edge surface disengages the firing mechanism sear surface then the first engagement edge disengages from the firing mechanism sear surface when the trigger shoe is moved rearward from the neutral position of the first firing mode to release the firing mechanism; and the second firing mode is a 1-stage firing mode wherein only the first surface can engage the firing mechanism sear surface while the selector switch is in the second position such that the second engagement edge does not significantly engage the firing mechanism sear surface as the trigger shoe is moved rearward from the neutral position of the second firing mode to release the firing mechanism.

3. The fire control group of claim 1, wherein:

the trigger is configured to rotate about a trigger pin of the fire control group;

the trigger sear surface is on a pillar extending from a trigger pin of the fire control group when the firearm is in the upright position;

the firing mechanism comprises a lateral protrusion supporting the firing mechanism sear surface; and the trigger and first disconnector are rotationally balanced about the trigger pin.

4. The fire control group of claim 1, wherein the firing mechanism is a hammer.

5. The fire control group of claim 1, wherein the selector switch further comprises a lever outside of a receiver of the firearm, wherein the lever is configured to rotate the selector switch from the first firing position to the second firing position and from the second firing position to the first firing position.

6. A fire control group for a firearm, said fire control group comp rising:

a firing mechanism operable to discharge the firearm upon release, said firing mechanism comprising a firing mechanism sear surface and a disconnector engagement surface;

a selector switch having a first firing position corresponding to a first firing mode and a second firing position corresponding to a second firing mode wherein the first firing mode is a 2-stage firing mode and the second firing mode is a 1-stage firing mode, said selector switch comprising:

a first plurality of cam surfaces configured to determine a trigger pull weight, an over travel distance, a neutral position, and a reset point of the first firing mode;

a second plurality of cam surfaces configured to determine a trigger pull weight, an over travel distance, a neutral position, and a reset point of the second firing mode;

a first disconnector configured to capture the firing mechanism subsequent to discharge of the firearm by engaging the disconnector engagement surface of the firing mechanism and to engage the firing mechanism during a second stage of the 2-stage firing mode to alter a trigger pull weight from the first stage of the 2 stage firing mode;

a trigger comprising:

a trigger sear surface configured to engage the firing mechanism sear surface prior to the break point and upon reset in the first firing mode and prior to the break point and upon reset in the second firing mode;

a trigger shoe operable to receive user input for displacing the trigger to release the firing mechanism rotating the trigger about a firing mechanism pin to disengage the trigger sear surface and the firing mechanism sear surface; and a trigger tang configured to engage the selector to set the neutral position in the first firing mode, set the neutral position in the second firing mode, set the over travel distance in the first firing mode, and set the over travel distance in the second firing mode.

7. The fire control group of claim 6, wherein:

the trigger is configured to rotate about a trigger pin of the fire control group;

the trigger sear surface is on a pillar extending from a trigger pin of the fire control group when the firearm is in the upright position;

the firing mechanism comprises a lateral protrusion supporting the firing mechanism sear surface; and the trigger and first disconnector are rotationally balanced about the trigger pin.

8. The fire control group of claim 6, wherein the firing mechanism is a hammer.

9. The fire control group of claim 6, wherein the selector switch further comprises a lever outside of a receive of the firearm, wherein the lever is configured to rotate the selector switch from the first firing position to the second firing position and from the second firing position to the first firing position.

10. The fire control group of claim 6, wherein the selector further has a safe position and further comprises a safe cam surface configured to contact a top surface of a bottom portion of the tang of the trigger and substantially prevent displacement of the trigger shoe from the neutral position of the first firing mode.

* * * * *